United States Patent [19]

Finger et al.

[11] 4,232,355

[45] Nov. 4, 1980

[54] IONIZATION VOLTAGE SOURCE

[75] Inventors: Richard H. Finger, Hollywood; Thomas J. Michel, Miami Lakes, both of Fla.

[73] Assignee: Santek, Inc., Hollywood, Fla.

[21] Appl. No.: 1,696

[22] Filed: Jan. 8, 1979

[51] Int. Cl.[2] ..... H01T 19/00

[52] U.S. Cl. ..... 361/235; 55/139; 55/150

[58] Field of Search ..... 361/235; 55/139, 150

[56] References Cited

U.S. PATENT DOCUMENTS

| | | | |
|---|---|---|---|
| 3,315,444 | 4/1967 | De Seversky | 55/122 |
| 3,716,966 | 2/1973 | De Seversky | 55/139 X |
| 3,740,925 | 6/1973 | Gothard | 55/139 X |
| 3,984,215 | 10/1976 | Zucker | 55/139 X |
| 4,103,202 | 7/1978 | Finger et al. | 313/336 |
| 4,138,233 | 2/1979 | Masuda | 361/235 X |

*Primary Examiner*—Alfred E. Smith

*Assistant Examiner*—Charles F. Roberts

*Attorney, Agent, or Firm*—Michael Ebert

[57] ABSTRACT

A voltage source adapted to excite a gas-ionization electrode so as to generate copious amounts of ionized gas without, however, producing measurable amounts of undesirable reactive or toxic chemical by-products. Yielded by the source is a unipolar voltage wave having a steady state DC component which, though below the ionization potential, serves to condition the gas to promote ionization. Imposed on the steady-state component is a gas-ionization component in the form of low-frequency surges, each composed of a short series of high-frequency pulses having a brief duration and an extremely high peak amplitude. The duration of the surge pulses is insufficient to break down the gas chemically, but the amplitude thereof is such as to effect intense gas ionization. The steady-state component prevents the electric field from collapsing completely in the intervals between pulses, thereby keeping the gas at a level approaching its ionization potential.

11 Claims, 4 Drawing Figures

IONIZATION VOLTAGE SOURCE

BACKGROUND OF INVENTION

This invention relates generally to high-voltage sources for gas ion generators, and more particularly to a source adapted to supply a unipolar voltage wave to a gas ionization electrode so as to generate copious amounts of ions without, however, producing deleterious chemical by-products.

Many industrial, therapeutic and research applications exist for gas ion generators, all of which include a discharge or ionization electrode to which a high voltage is applied. Though the present invention is useful in conjunction with all known forms of gas-ion generators, such as those used industrially for electrostatic separation and electrostatic coating or imaging, for purposes of explanation and analysis we shall consider the ionization problems encountered in an electrostatic precipitator for removing suspended particles from a gas by ionically charging the particles.

In an electrostatic precipitator, unipolar ions are produced by a discharge electrode, the ions migrating across the gap between this electrode and a collector electrode under the influence of an electric field established therebetween. In so migrating, the ions attach themselves to the aerosol particles moving with the gas passing between the electrodes, the charged particles being attracted to the collector.

In one elementary form of electrostatic precipitator in widespread use, the discharge electrode is a wire coaxially supported within a tubular collector electrode. This wire has a much smaller radius of curvature than the tubular collector, the air gap or inter-electrode space between these electrodes being very large compared to the radius of the wire. When, therefore, a voltage is impressed across these electrodes and the potential difference therebetween is raised, a point is reached where the air near the more sharply-curved discharge electrode breaks down, but only to an extent producing a corona discharge.

The electric field varies inversely with the radius of the wire. For a given air gap dimension, the level of voltage needed to produce a corona discharge is below that necessary to completely break down the dielectric of air to produce a spark discharge across the gap. Since an understanding of this distinction is vital to the invention, the behavior of corona and spark discharges will be further analyzed.

A corona discharge is a highly active glow region surrounding a discharge electrode. In the above described elementary form of precipitator, this electrode is constituted by a wire, the glow region extending a short distance beyond the wire. Assuming that the wire is negatively charged, the free electrons in the gas in the region of the intense electric field surrounding the wire gain energy from this field to produce positive ions and other electrons by collision. In turn, these new electrons are accelerated and produce further ionization.

This cumulative process results in an electron avalanche in which the positive ions are accelerated toward and bombard the negatively-charged wire. As a consequence of such ionic bombardment, secondary electrons are ejected from the wire surface which act to maintain the discharge. Moreover, high-frequency radiation originating from excited gas molecules lying within the corona region contribute to the supply of secondary electrons.

The electrons emitted from the negatively-charged wire or discharge electrode are drawn toward the positively-charged collector electrode. As these electrons advance into the weaker field away from the wire, they tend to form negative ions by attaching themselves to neutral oxygen molecules. These negative ions create a dense unipolar cloud that occupies most of the gap between the electrodes and constitutes the only current in the entire space outside the corona glow region. This space charge functions to retard the further emission of negative charge from the corona region and in this way restricts the ionizing field adjacent the wire, thereby stabilizing the discharge.

The type of corona produced depends on the polarity of the discharge or ionizing electrode. In the example given above, we have assumed a negative polarity, in which case positive ions are accelerated toward the electrode and negatively-charged oxygen ions are repelled therefrom to produce a corona discharge. Conversely, when the polarity of the ionizing electrode is positive, negative ions are accelerated toward the electrode, causing the breakdown of air molecules with the result that positive ions are repelled outward from the ionizing electrode to create a corona glow.

When, however, the voltage applied to the ionizing electrode is further elevated to a level exceeding the point at which a corona discharge is maintained in a stable condition, the air dielectric then completely breaks down, as a result of which the air in the gap is rendered relatively conductive to sustain a spark discharge which is accompanied by a heavy current flow.

An electrostatic precipitator attains its highest operating efficiency under optimum ionization conditions when the voltage applied to the discharge electrodes approaches the point of transition between an incomplete breakdown or corona discharge producing a copious supply of ions and complete air dielectric breakdown or spark discharge which effectively short circuits the precipitator and renders it inoperative.

But in practice one must be careful to apply a voltage to the ionizing or discharge electrode of a precipitator which is well below the level at which complete air breakdown is experienced, for the air breakdown characteristics of air in a precipitator varies with the nature and concentration of the pollutants therein as well as barometric pressure conditions. Moreover, the breakdown of the dielectric of air produces chemical reactions which constitute as serious health hazard; for this breakdown gives rise to toxic ozone and harmful oxides of nitrogen. But quite apart from this health hazard is the fact that ozone is highly reactive with electrical insulation and other structures and therefore has a destructive effect on the associated equipment.

In this explanation, we have assumed that the gas being ionized is free air. But the problems arising from the concomitant production of deleterious by-products is not limited to air, for the ionization of other gases is accompanied by undesirable chemical by-products when spark discharges are produced.

SUMMARY OF INVENTION

In view of the foregoing, the main object of this invention is to provide a voltage source adapted to apply a unipolar voltage wave to an ionization electrode to generate copious amounts of ionized gas without producing measurable amounts of undesirable reactive or toxic chemical by-products.

More particularly, it is an object of this invention to provide a voltage source whose unipolar wave output includes periodic voltage surges having peak amplitudes that greatly exceed the highest tolerable level attained by conventional power supplies for an ionization electrode, the source therefore generating a much greater amount of gas ions without, however, producing deleterious chemical by-products.

A salient feature of the present invention is that it overcomes the limitations normally imposed on conventional high-voltage sources for ionization electrodes which necessarily restrict the maximum amplitude of the continuously applied voltage to a level below the spark discharge region. The significant advantage of the present invention is that it makes possible the application of extremely high voltages to an ionization electrode to bring about intense ionization of the gas but for a duration which falls short of the complete breakdown point of the gas dielectric.

The present invention is based on the recognition that the time required to effect ionization of a gas is briefer than that necessary to effect complete dielectric breakdown, for the chemical reactions entailed in the breakdown process takes place at a relatively slow pace. If, therefore, a high voltage is continuously maintained on an ionization electrode or is in a pulsatory form in which each pulse is of relatively long duration, then the phenomenon of ionization will be followed by at least incipient dielectric breakdown and will inevitably result in objectionable by-products.

In known types of ionization systems, even if the voltage applied to the ionization electrode is just high enough to effect ionization and is well below the spark discharge region, because it is maintained continuously or for relatively prolonged pulse periods, then in the case of free air, ozone and other by-products will usually be produced. But with the present invention, despite the fact that the applied unipolar surges attain peak amplitude levels far above the highest constant level considered safe in a conventional arrangement, no objectionable amounts of ozone or other reactive or toxic by-products are produced, yet the amount of ions emitted by the ionization electrode greatly exceeds that produceable in a conventional system.

Briefly stated, these objects are attained in a voltage source in accordance with the invention for an ionization electrode, the source producing a unipolar voltage wave having a steady state direct voltage component which though below the ionization potential of the gas being ionized, serves to promote ionization of the gas.

Imposed on the steady-state component is a gas-ionization component in the form of periodic low-frequency surges, each of which is composed of at least one sharp pulse having an extremely high peak amplitude. By a sharp pulse is meant one having a steep rise time and a fast slew rate. This surge serves to ionize the gas, but its extremely brief duration is insufficient to break down the gas chemically.

The DC steady state component prevents the electric field produced by each pulse of the gas-ionization component from collapsing completely in the intervals between pulses, thereby keeping the gas at a level approaching its ionization potential. But since the steady-state component is below the ionization potential, there is virtually no ionization because of it and no chemical breakdown is experienced.

In practice, each low-frequency surge of the ionization component may be constituted by a high-frequency series of sharp pulses having a constant peak amplitude or an exponential amplitude decay, depending on how the pulses are generated.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

The Basic System

Figure 1:
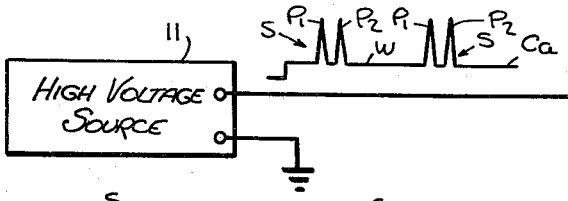
FIG. 1 is a block diagram of a gas ion-generating system composed of an ionization electrode and a voltage source in accordance with the invention.

Referring now to the drawings and more particularly to FIG. 1, there is shown a system in accordance with the invention for emitting a copious supply of gas ions without producing deleterious chemical by-products. In this system, use is made of a gas-ionization electrode 10 which in practice may be in any known form adapted to ionize air or gas by the application of a high voltage thereto.

Thus the ionization electrode may be of the type disclosed in the Finger-Michel U.S. Pat. No. 4,103,202, in which a point electrode is mounted in a concave chamber covered by an iris plate to produce an extensive ion cloud. Or the ionization electrode may be the discharge electrode of an electrostatic precipitator such as that described in the deSeversky U.S. Pat No. 3,315,444.

Applied to ionization electrode 10 is a unipolar high voltage wave derived from a high voltage source 11 in accordance with the invention. The wave pattern W, as illustrated in FIG. 1, is constituted by a steady state direct current component Ca, which is modulated by an ionization component formed by low-frequency surges S, each of which consists of at least one sharp pulse $P_1$ or voltage spike having an extremely high amplitude. In practice, each surge S is preferably constituted by a short high-frequency series of pulses $P_1$, $P_2$, etc., each series having about 5 to 50 pulses, depending on the ionization requirements of the system.

Pulses $P_1$, $P_2$, etc., of each surge have a steep rise time, this being the interval between the instant at which the instantaneous amplitude first reaches specified lower and upper limits, as well as a steep decay time, this being the interval between the instant at which the instantaneous amplitude last reaches specified upper and lower limits. Thus the slewing rate of the power supply must be very fast. In practice, the rise time of the pulses should be 400μ/microsecond or faster, but the invention is not limited to this rate.

Assuming pulses of constant amplitude, their peak value preferably lies in a range of about 5 kilovolts to 120 kilovolts, depending on the ionization requirements of the system. It must be borne in mind that in the conventional electrostatic precipitator, ionization electrode potentials exceeding 15 to 20 kilovolts cannot be tolerated; for above this level, air dielectric breakdown and spark-over occurs. But with the present invention, one can produce intense ionization of a gas with exceedingly high voltages without concomitant breakdown of the air and the resultant undesirable by-products.

Since the sharp pulses $P_1$, $P_2$, etc., in each series of a surge S are produced at a high-frequency rate, the time or spacing t therebetween is very narrow, whereas the interval T between successive surges in the voltage wave is of relatively long duration; for the surges are generated at a low frequency rate.

Ionization takes place more readily at high voltage; but as noted previously, should the high voltage in the ionization electrode be maintained continuously or for relatively long-duration pulsatory periods, then breakdown of the air dielectric which requires a longer time than that needed for ionization takes place. But with the present invention, the fast rise time voltage spikes of high amplitude do not last long enough to break the air down chemically.

The succession of pulses in each surge S produces a series of ionization bursts, but these occur so quickly as to fall short of air breakdown. However, it is necessary to follow each series of bursts with a rest interval T before the next surge of pulses is produced in order to retard or arrest any incipient breakdown of the air and before air is again stressed by an extremely high voltage field.

The surge or ionization component is imposed on steady-state DC component Ca which has a voltage level above ground of about 1 to 2 kilovolts. The resultant steady state field stresses the air to a point approaching the ionization potential, but because this DC bias is lower than the ionization potential, there is virtually no ionization because of it, nor any chemical breakdown of the gas. However, this DC bias prevents the electric field by collapsing completely in the intervals between pulses and thereby conditions or stresses the gas to render it conducive to ionization.

In practice, the low-frequency rate at which the surges S are produced may be at, but not limited to, the standard power line frequently (50 or 60 Hz), whereas the high-frequency rate of the pulses may be, but not limited to, 900 to 1200 Hz.

Also, in practice the pulses in each surge need not be of constant peak amplitude, but may decay exponentially in amplitude, so that the first pulse in the series thereof is of extremely high amplitude, while the succeeding pulses progressively decrease in peak amplitude. This exponential decay is acceptable, in that the first pulse triggers off an intense ionization of the gas and the succeeding pulses, now that ionization has been initiated, need not be of the same extremely high potential to promote further ionization.

Figure 2:
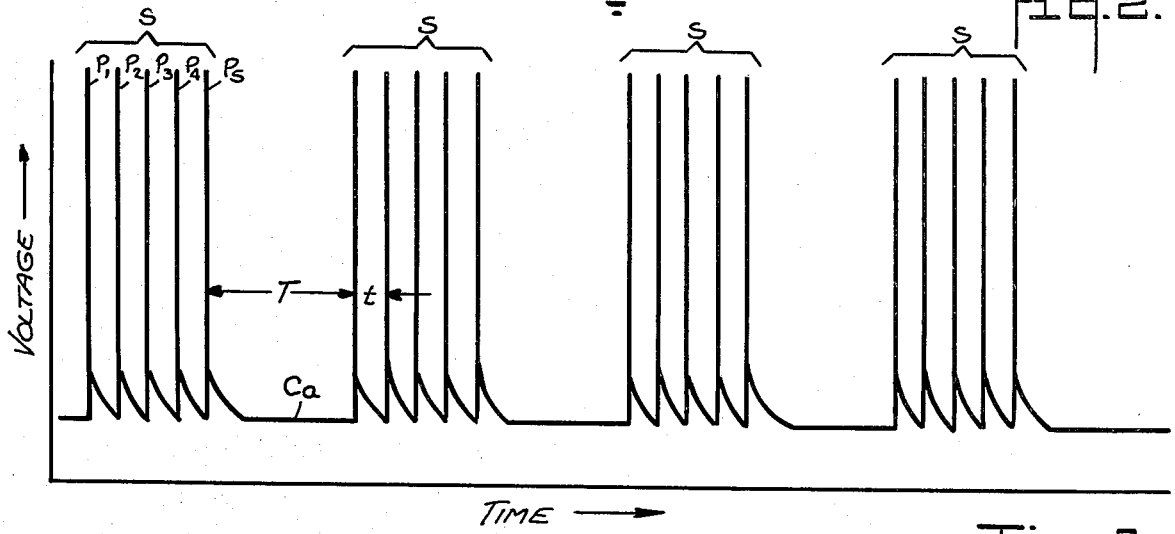
FIG. 2 illustrates one form of an ionization voltage wave pattern produced by the voltage source.
Figure 3:
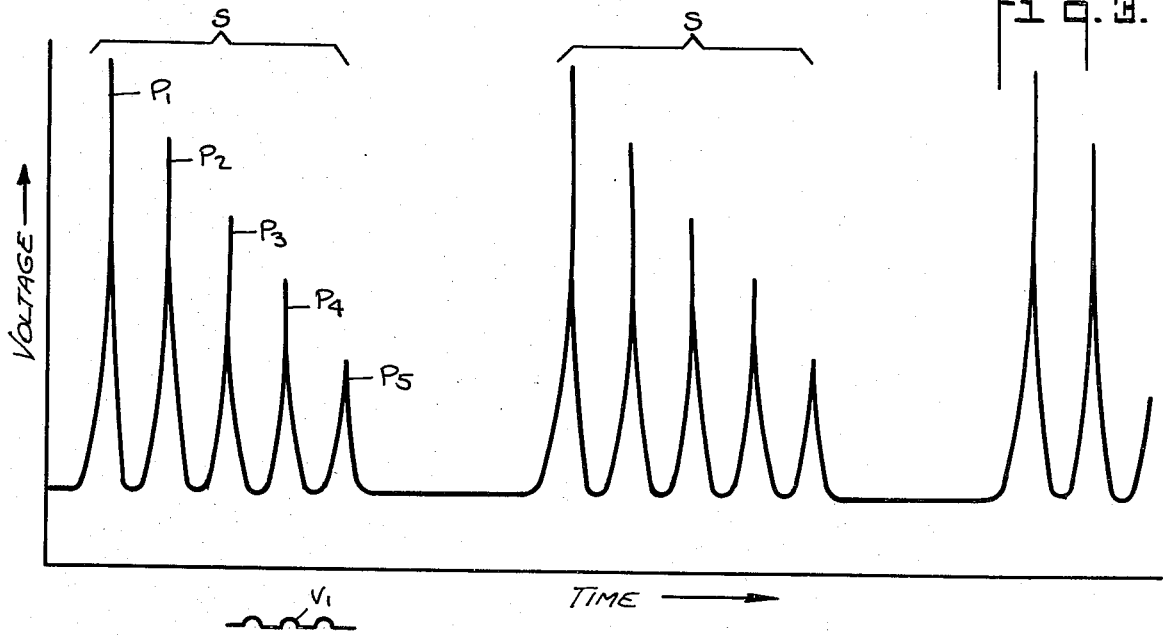
FIG. 3 illustrates an alternative ionization voltage-wave pattern produced by the voltage source.

FIG. 2 shows in enlarged form a voltage wave pattern in accordance with the invention in which each surge S is composed of a series of five unipolar pulses $P_1$ to $P_5$, all having substantially the same peak amplitude, this ionization component being imposed on the steady state DC component Ca. In FIG. 3, there is illustrated a similar voltage wave pattern; but in this instance, pulses $P_1$ to $P_5$ decay exponentially in the course of each surge.

Similarly, the above described voltage source may be used to generate an intense electrostatic field on or from a planar or spherical electrode without generating noxious or undesirable chemical byproducts such as ozone or oxides of nitrogen.

The Voltage Source

Figure 4:
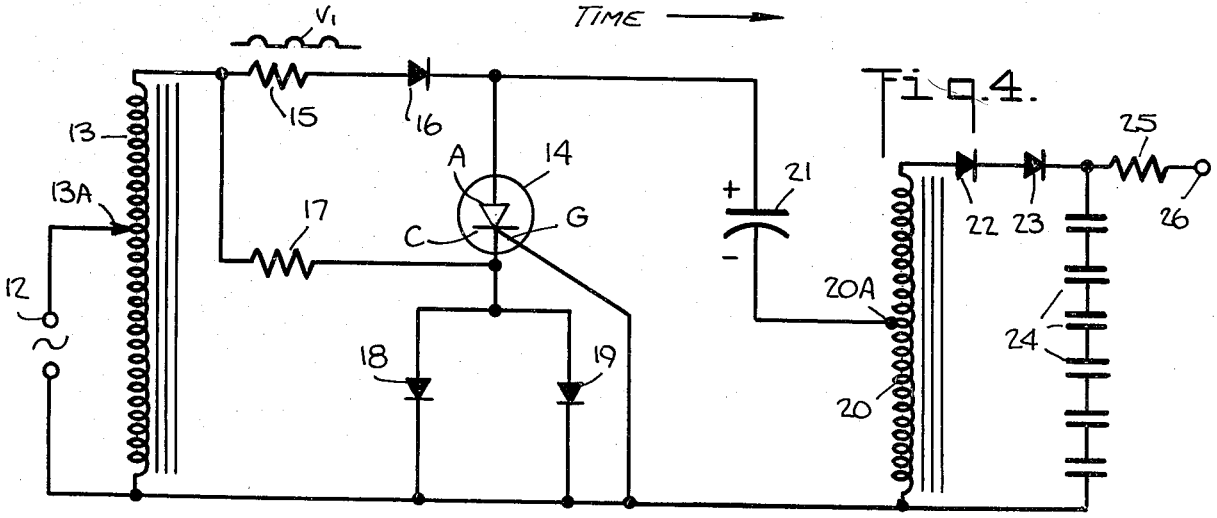
FIG. 4 is a schematic circuit diagram of a preferred embodiment of an ionization voltage source in accordance with the invention.

Referring now to FIG. 4, there is shown the circuit diagram of a preferred embodiment of a voltage source in accordance with the invention for a gas-ionization electrode. This source, which is powered from a standard commercial AC 60 Hz line to which input terminals 12 are connected, includes a power auto-transformer 13 whose adjustable tap 13A determines the output voltage yielded thereby. We shall assume that the tap is adjusted to produce an output of 340 volts AC.

A silicon-controlled rectifier (SCR) 14 is provided, the anode A of which is connected through a diode rectifier 16 in series with a current-limiting resistor 15 to the upper end of transformer 13, this end also being connected through a bias resistor 17 to the cathode C of the SCR device. The lower end of transformer 13 is connected through parallel biasing diodes 18 and 19 to the cathode of the SCR device.

The lower end of transformer 13 is also connected both to the gate G of SCR device 14 and the lower end of an autotransformer 20. The tap 20A on transformer 20 determines the effective ratio of the primary to the secondary and is connected through a charging capacitor 21 to the anode of SCR device 14. The AC output of transformer 20 is rectified by series-connected diodes 22 and 23 to produce a DC voltage that is filtered by a series chain of capacitors 24. The output voltage wave developed across capacitor 24 is fed through a series resistor 25 whose value determines the output impedance of the source to an output terminal 26 which is connectable to the ionization electrode.

Operation

SCR device 14 is a silicon rectifier having a pnpn structure that blocks current in both directions unless it is triggered into forward conduction by a pulse applied to its gate electrode G. When such conduction is initiated, conduction continues even when the control signal is removed until the anode supply is reduced, reversed or removed.

The half-wave rectified voltage $V_1$ obtained from transformer 13 through diode 16 is in the form of 60 Hz pulses since the power line is a 60 Hz source. This voltage is applied between the anode and cathode of the SCR device, the cathode being biased above ground by diode pair 18 and 19 to facilitate a rapid turn on of the SCR device.

Gate G of the SCR device is initially at zero potential; but when capacitor 21 is charged by voltage $V_1$ through the primary of transformer 20, the potential on the gate of the SCR device rises until the trigger point is reached to render it conductive, thereby abruptly discharging capacitor 21 through the SCR device. This discharge results in a high intensity current pulse through the primary of transformer 20 which shock excites the transformer.

Transformer 20 is of the open-core ferrite type and it functions as an oscillatory or ringing circuit. Shock excitation is the excitation of natural oscillations in an oscillatory system due to the sudden acquisition of energy from an external source, which in this instance is capacitor 21 when discharged through the SCR device.

This ringing or oscillation produces a damped wave of extremely high amplitude which is rectified to produce a series of pulses that decay exponentially, as shown in FIG. 3. Capacitor 24 maintains a minimum DC output level, thereby providing the required steady state component Ca on which is imposed at a 60 Hz low-frequency rate, surges S constituted by the high-frequency series of unipolar pulses $P_1$, $P_2$ etc. or spikes.

The frequency of these pulses is determined by the ringing characteristics of transformer 20 and, as noted previously, this rate can be as high as 1200 Hz.

The invention is not limited to the voltage wave form generator shown in FIG. 4. One may, for example, using known pulse circuit techniques, provide a high-frequency, high-amplitude voltage pulse generator whose output is chopped at a low frequency rate to provide a wave form of the type shown in FIG. 2.

While there has been shown and described a preferred embodiment of an ionization voltage source in accordance with the invention, it will be appreciated that many changes and modifications may be made therein without, however, departing from the essential spirit thereof.

We claim:

1. A voltage source adapted to apply voltage excitation to a gas-ionization electrode in a wave form resulting in the generation of copious amounts of ionized gas without, however, producing substantial amounts of undesirable chemical by-products, the time required to produce incipient dielectric breakdown resulting in said byproducts being greater than that required to effect ionization of the gas, said gas having a predetermined ionization potential, said source comprising:

A means to produce a unipolar voltage wave having a steady state direct-current component which is below said ionization potential yet at a level serving to create an electric field conducive to subsequent gas-ionization; and B means to impose a gas-ionization component on the steady state component in the form of periodic surges which are separated by relatively long intervals, each surge being composed of at least one sharp unipolar pulse having a steep rise time and a fast slew rate, and having a high peak amplitude, the duration of the pulse relative to the incipient breakdown time being insufficient to break down the gas chemically, but the peak amplitude thereof being such as to effect intense ionization of the gas, the steady state component acting to prevent the electric field from collapsing completely in the interval between surges, thereby keeping the gas at a level approaching its ionization potential.

2. A voltage source as set forth in claim 1, wherein the peak amplitude of said pulse is in a range of about 5 to 150 kilovolts.

3. A voltage source as set forth in claim 1, wherein each surge is composed of a series of high-frequency pulses.

4. A voltage source as set forth in claim 3, wherein said pulses in the series are of constant peak amplitude.

5. A voltage source as set forth in claim 3, wherein said pulses in the series have peak amplitudes which decay exponentially.

6. A voltage source as set forth in claim 1, wherein said voltage source includes a transformer which is shock excited at a low-frequency rate to produce, in response to each shock, a series of high-frequency pulses which are rectified to produce said ionization component.

7. A voltage source as set forth in claim 6, wherein said transformer is of the open-core ferrite type.

8. A voltage source as set forth in claim 6, wherein shock excitation of said transformer is effected by a capacitor that is periodically charged at said low-frequency rate and discharged through the primary of said transformer.

9. A voltage source as set forth in claim 8, wherein said capacitor is discharged through a silicon-controlled rectifier.

10. The method of ionizing a gas such as free air to produce a copious supply of ions without the concomitant production of undesirable chemical by-products such as ozone, the time required to produce incipient dielectric breakdown resulting in said by-products being greater than that required to effect ionization of the gas, said method comprising the steps of:

A applying to an ionization electrode a unipolar voltage having a steady state component which is below the ionization potential of the gas yet serves to stress the gas to render it conducive to subsequent ionization; and B imposing on said steady state component an ionization component constituted by periodic surges separated by relatively long time intervals, each surge including at least one sharp unipolar pulse having a steep rise time and a fast slew rate, and having a peak amplitude inducing intense ionization of the gas, the pulse duration relative to the incipient breakdown time being insufficient to effect chemical breakdown of the gas.

11. A voltage source adapted to apply voltage excitation to an electrode in a wave form resulting in the establishment of an intense electrostatic field without, however, producing substantial amounts of undesirable chemical by-products, said gas having a predetermined ionization potential, the time required to produce incipient dielectric breakdown resulting in said by-products being greater than that required to effect ionization of the gas, said source comprising:

A means to produce a unipolar voltage wave having a steady state direct-current component which is well below said ionization potential; and B means to impose a pulsatory component on the steady state component in the form of periodic surges which are separated by relatively long intervals, each surge being composed of at least one sharp unipolar pulse having a steep rise time and a fast slew rate and having a high peak amplitude, the duration of the pulse relative to the incipient dielectric breakdown time being insufficient to break down the gas chemically, but the peak amplitude thereof being such as to produce an intense electrostatic field, the steady state component acting to prevent the electric field from collapsing completely in the interval between surges.

* * * * *